US007191897B2

(12) United States Patent
Lai

(10) Patent No.: US 7,191,897 B2
(45) Date of Patent: Mar. 20, 2007

(54) CONTAINER CYLINDER FOR A SANITARY BRUSH

(76) Inventor: Ming-Hsiao Lai, No. 8, Lane 2, Kung Chi Village, Ta Tsuen Hsiang, Chang-Hua Hsien (TW)

( * ) Notice: Subject to any disclaimer, the term of this patent is extended or adjusted under 35 U.S.C. 154(b) by 0 days.

(21) Appl. No.: 10/856,952

(22) Filed: Jun. 1, 2004

(65) Prior Publication Data

US 2004/0262171 A1 Dec. 30, 2004

(30) Foreign Application Priority Data

Jun. 10, 2003 (TW) ..... 92210555 U

(51) Int. Cl.
*A45D 44/18* (2006.01)
*B43K 5/06* (2006.01)

(52) U.S. Cl. ..... 206/15.3

(58) Field of Classification Search ..... 206/15.2, 206/15.3, 361, 362, 362.2, 362.3, 398
See application file for complete search history.

(56) References Cited

U.S. PATENT DOCUMENTS 1,481,935 A * 1/1924 Terrell ..... 206/362.3
1,939,718 A * 12/1933 Muhlbach ..... 206/398

* cited by examiner

*Primary Examiner*—Mickey Yu
*Assistant Examiner*—Jerrold Johnson
(74) *Attorney, Agent, or Firm*—Egbert Law Offices

(57) ABSTRACT

A container for a sanitary brush has a cylinder container with a cover affixed thereover. The cover has a handle extending outwardly therefrom and a brush positioned on an interior of said container. The container has internal edge bondings at an upper end and a lower end thereof. The cover has a bottom that is positioned in surface-to-surface contact with an exterior wall of the container. A plastic cylinder is received within a hollow interior of the container.

2 Claims, 7 Drawing Sheets

CONTAINER CYLINDER FOR A SANITARY BRUSH

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a container cylinder for a sanitary brush, and more particularly to a container cylinder of improved structure.

BACKGROUND OF THE INVENTION

The container cylinder for a sanitary brush is widely applied by the general public for its pleasing appearance and sanitation functions. As shown in FIG. 7, the typical container cylinder for a sanitary brush comprises handle 81, brush 82, cover 83 and a container cylinder 84. The cover 83 is installed between the handle 81 and brush 82 for spacing, while the container cylinder 84 is available with a hollow structure having a an upper end and a lower end. When you want to put the brush 82 into the container cylinder 84, you have to put the cover 83 on the upper end to avoid the brush 82 falling down or exposure from the lower end.

To prevent any incised wound by a sharp edge, the upper end and lower end shall be subjected to external edge bonding 87 and internal edge bonding 89 (as shown in FIG. 7). However, with regard to the structure of conventional container cylinder 84 that the upper end and lower end are subjected to external edge bonding 87 and internal edge bonding 89, respectively, it is necessary to firstly process the edge bonding at one end and then displace the edge bonding machine for another one in a time-consuming way. And, as shown in FIGS. 8 and 9, the upper end 85 is provided with the external edge bonding 87, there is an unsealed space (L) between the cover bottom 90 and the lateral surface of the container cylinder 84. Given the fact that the container cylinder for sanitary brush has become one of popular consumer goods, its price will gradually decline under the market competition. For this reason, it is necessary to save its manufacturing cost and promote its output and quality in an efficient way to meet the demanding requirements of this industry.

Therefore, based upon the above-mentioned disadvantages of container cylinder for a sanitary brush, e.g. lower manufacturing speed, higher cost and unsealing between the cover and cylinder, this industry shall assume the responsibility of making some pioneering R&D for a utility model.

BRIEF SUMMARY OF THE INVENTION

The present invention can offer an improved efficiency as detailed below.

1. To provide a modified structure of the container cylinder for a sanitary brush.

2. As both the upper and lower nozzles of the container cylinder are available with a structure of internal edge bonding, only a single machine and mould shall be required, thereby reducing the manufacturing cost and promoting its output and quality in an efficient way. And, as the cover is closely attached to the cylinder, a modified and cost-saving streamline is made available to meet the requirements of this industry.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
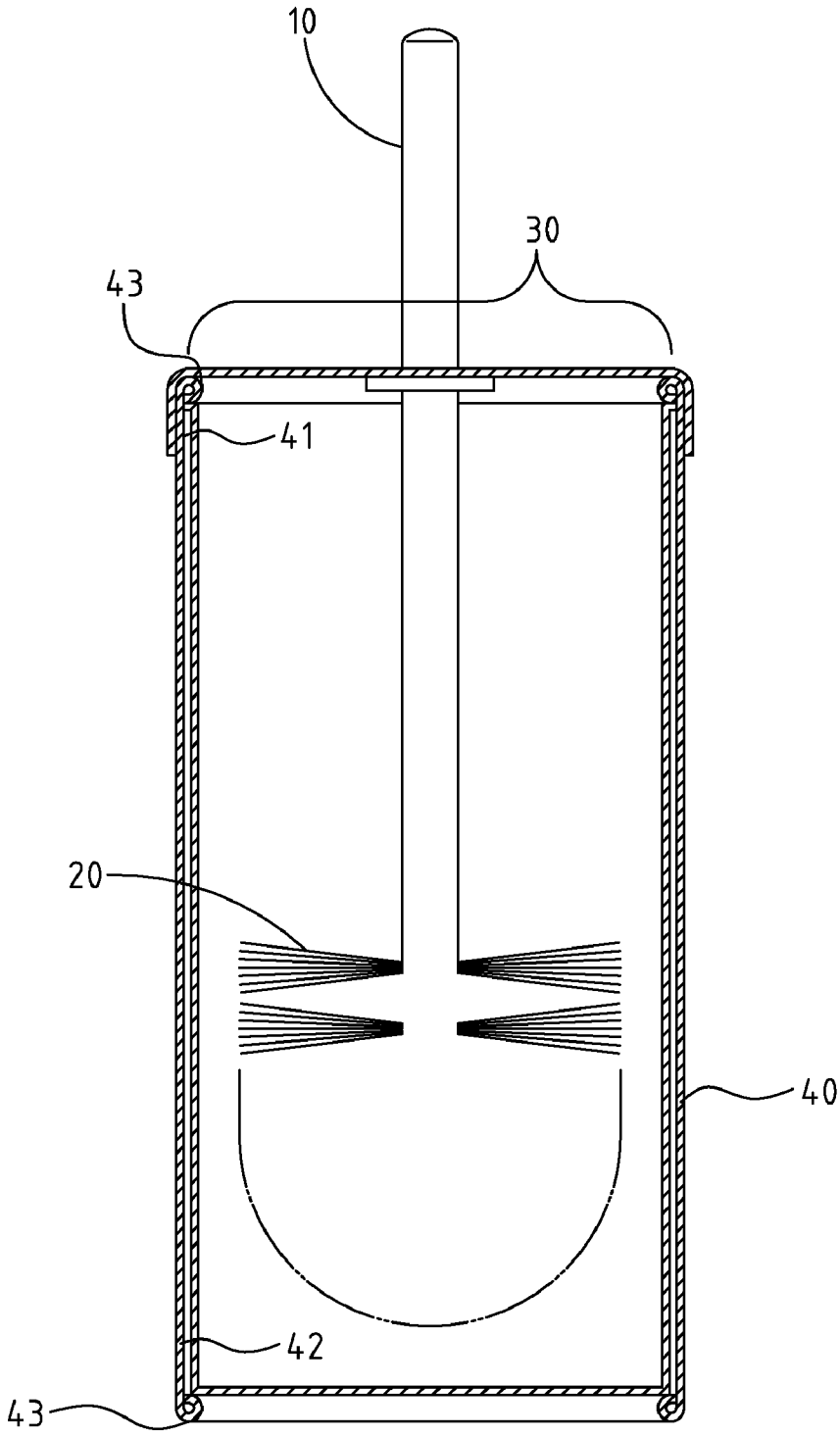
FIG. 1 shows a longitudinal cross sectional view of the installed invention.

As shown in FIG. 1, a container cylinder for sanitary brush embodied in the present invention comprises: handle 10, brush 20, cover 30 and container cylinder 40, of which the handle 10 is connected to the brush 20. And, the cover 30 is installed between the handle 10 and brush 20 for spacing, while the container cylinder 40 is available with a hollow structure of upper end 41 and lower end 42. When you want to put the brush 20 into the container cylinder 40, you have to put the cover 30 on the upper end 41 of the container cylinder 40 so as to avoid the brush 20 falling down or having exposure from the lower end 42 of the container cylinder 40.

As both the upper end 41 and lower end 42 of the container cylinder 40 are available with a structure of internal edge bonding 43, only a single machine and mould shall be required to manufacture the internal edge bonding 43 of the container cylinder 40, thereby reducing the manufacturing cost and promote its output and quality in an efficient way.

Figure 2:
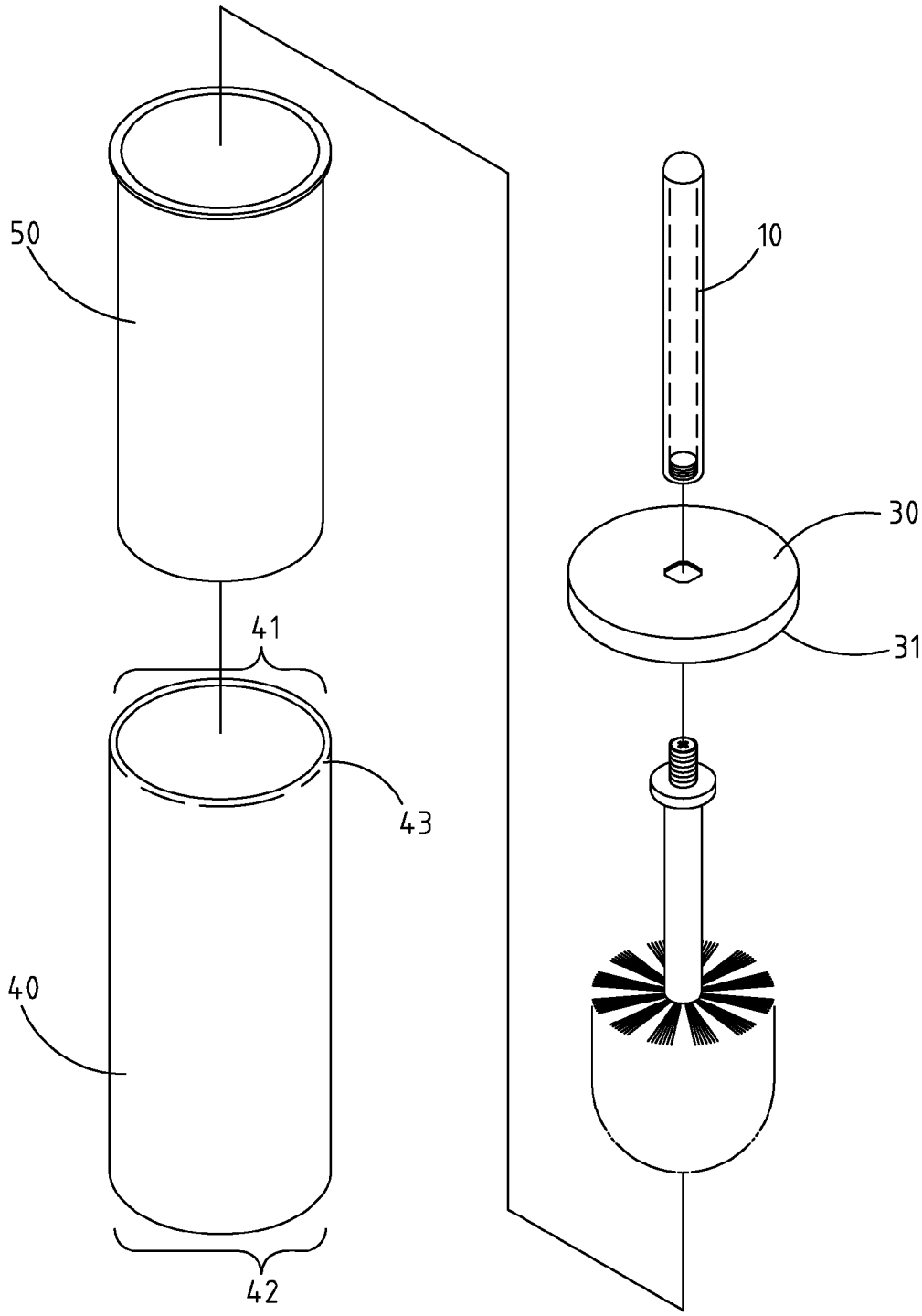
FIG. 2 shows an exploded perspective view of the present invention.
Figure 3:
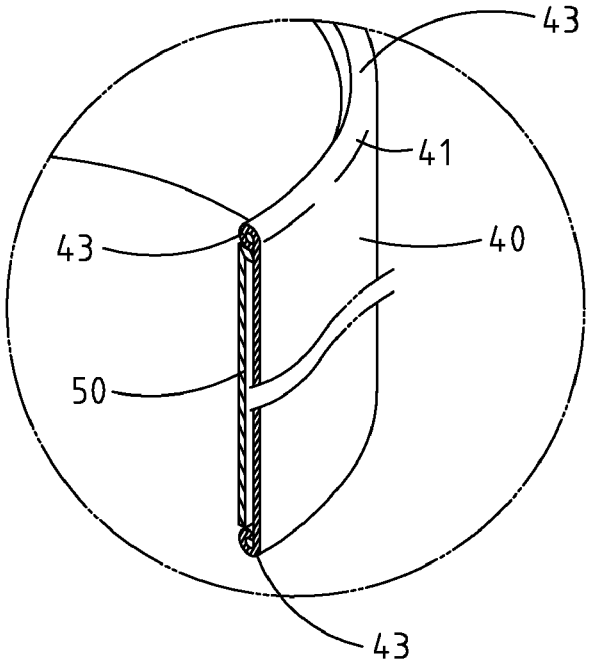
FIGS. 3–4 show isolated partial sectional views of the internal edge bonding and the lid on the container cylinder, respectively.
Figure 4:
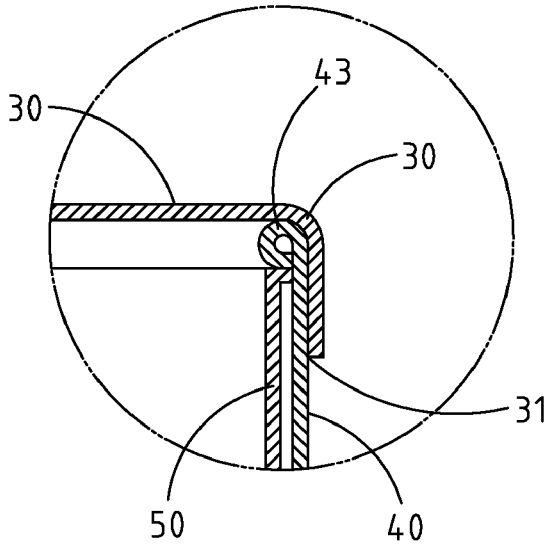
Figure 5:
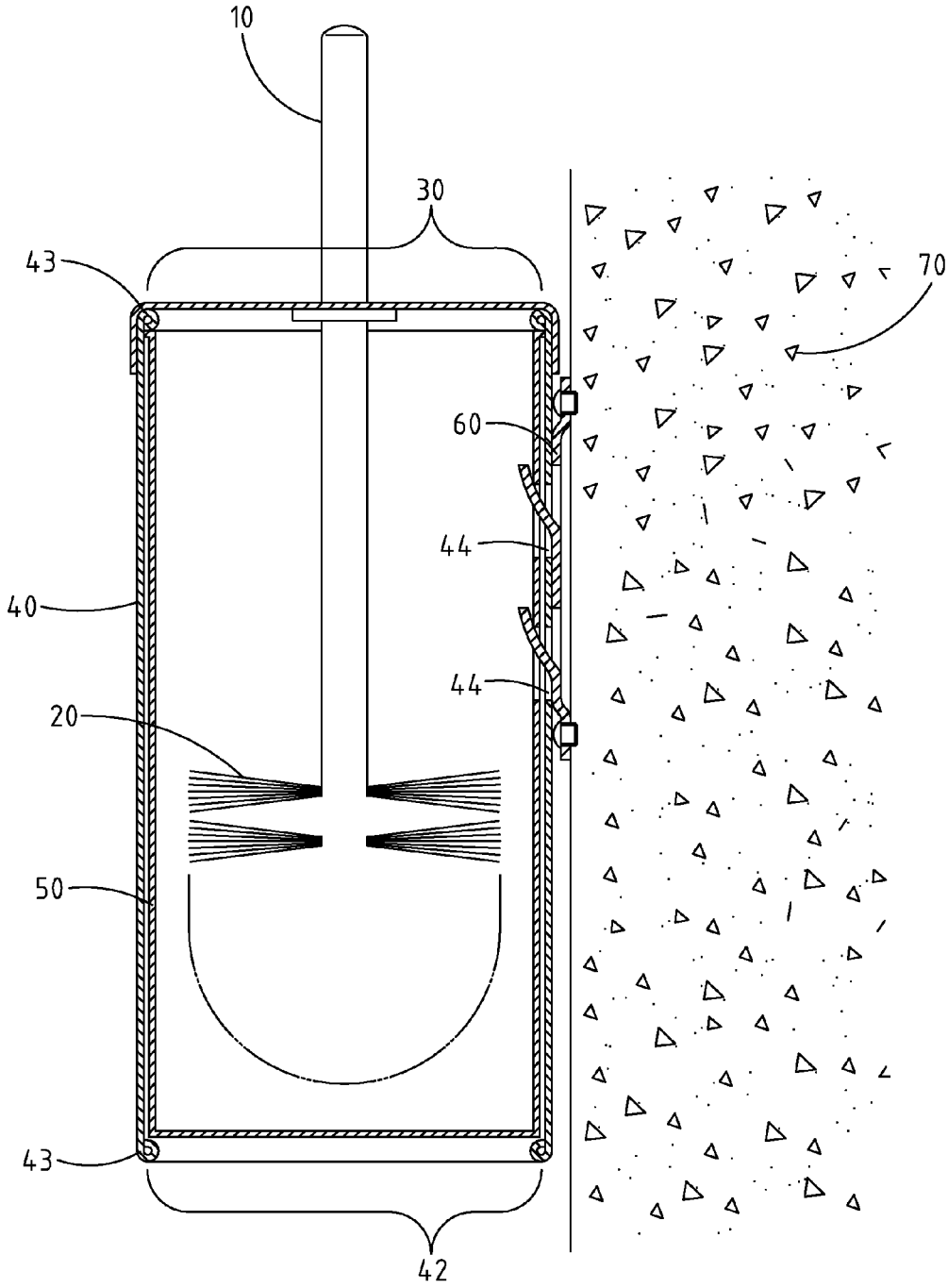
FIG. 5 shows a sectional view of the installation of the present invention.
Figure 6:
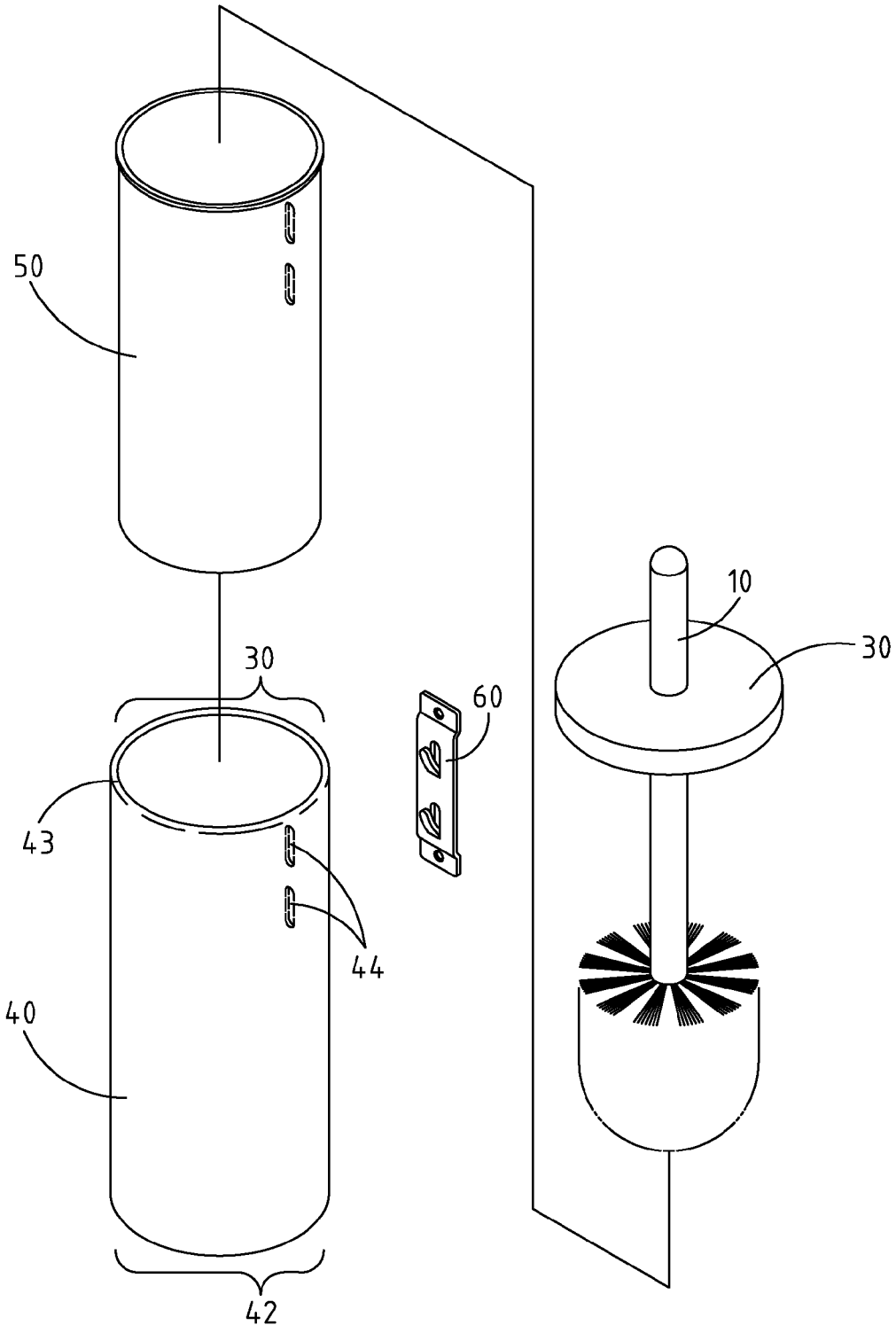
FIG. 6 shows an exploded perspective view of the present invention.
Figure 7:
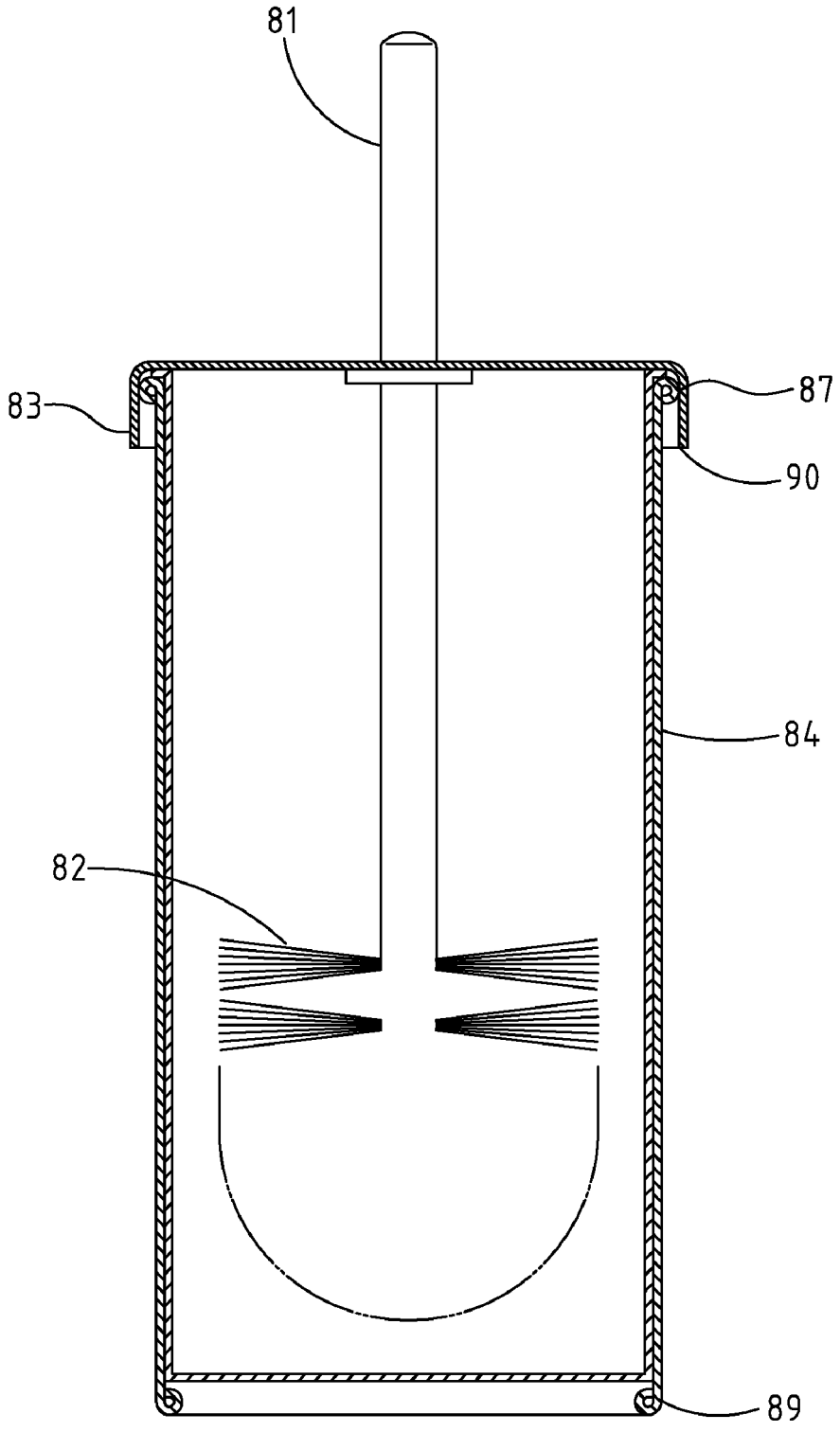
FIG.7 PRIOR ART
FIG. 7 shows a sectional view of the prior art container and brush.
Figure 8:
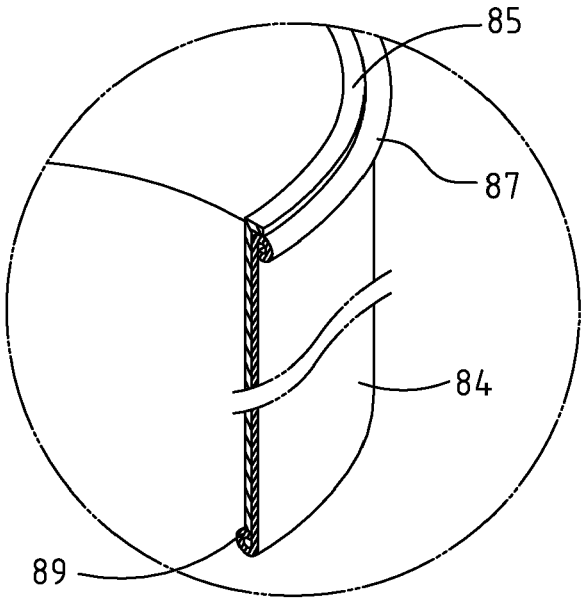
FIG.8 PRIOR ART
FIGS. 8–9 show isolated partial sectional views of the prior art internal and external edge bonding and the prior art lid on the container cylinder.
Figure 9:
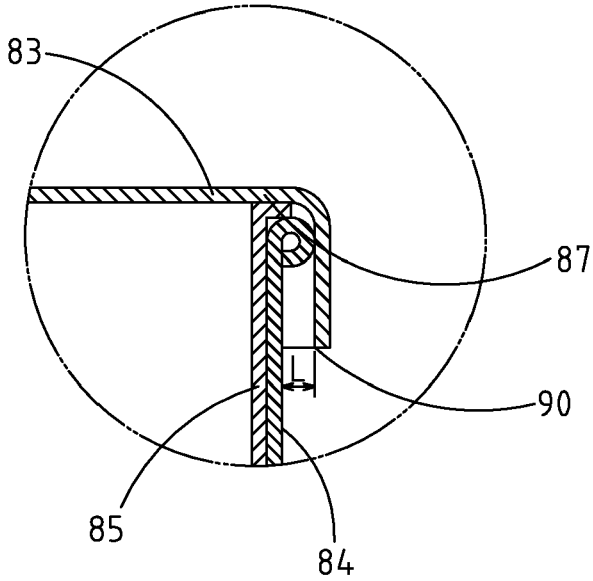
FIG.9 PRIOR ART

As shown in FIGS. 2–3, when the upper end 41 is subjected to internal edge bonding 43, the cover bottom 31 and lateral surface of the container cylinder 40 are sealed. As shown in FIGS. 5 and 6, the lateral surface of the container cylinder 40 is provided with a locking hole 44 and a lockset 60 for fixation into the wall 70. When it is fixed into the wall 70, the container cylinder 40 is closely attached to the wall 70 for a lesser space.

As shown in FIG. 5, the container cylinder 40 is provided with a plastic cylinder 50, which is helpful to corrosion protection of the container cylinder 40 as well as cleaning and replacement.

I claim:

1. An apparatus comprising:

a container having a cylinder shape, said container having an upper end and a lower end, said container having a hollow interior, each of said upper end and said lower end having an internal edge bonding, said internal edge bonding being a curl of material of said container looping inwardly such that an edge of said curl contacts an inner wall of said container;

a plastic cylinder received within said container, said plastic cylinder having a hollow interior and a bottom extending across a lower end thereof, said lower end abutting said curl at said lower end of said container, said plastic cylinder having a flange at an upper end thereof abutting an underside of said curl at said upper end of said container, said flange having a larger outside diameter than the bottom of the plastic cylinder;

a brush having a handle extending therefrom; and a cover affixed to said handle between one of said handle and said brush, said cover having a planar surface overlying said curl at said upper end of said container, said cover having a wall extending downwardly from a periphery of said planar surface, said wall being in continuous surface-to-surface contact with an exterior wall of said container.

2. The apparatus of claim 1, said container having a wall-mount connected to a surface thereof.

* * * * *